US005773926A

United States Patent [19]

Maya et al.

[11] Patent Number: 5,773,926

[45] Date of Patent: Jun. 30, 1998

[54] ELECTRODELESS FLUORESCENT LAMP WITH COLD SPOT CONTROL

[75] Inventors: Jakob Maya, Brookline; Oleg Popov, Needham, both of Mass.

[73] Assignee: Matsushita Electric Works Research and Development Laboratory Inc, Woburn, Mass.

[21] Appl. No.: 559,557

[22] Filed: Nov. 16, 1995

[51] Int. Cl.[6] ..... H01J 61/28

[52] U.S. Cl. ..... 313/490; 313/15; 313/550; 315/117

[58] Field of Search ..... 313/485, 492, 313/493, 15, 34, 547, 550, 551, 565; 315/248, 112, 117, 267

[56] References Cited

U.S. PATENT DOCUMENTS

| | | | |
|---|---|---|---|
| 2,975,330 | 3/1961 | Bloom et al. | 315/248 |
| 4,262,231 | 4/1981 | Anderson et al. | 313/490 |
| 4,622,495 | 11/1986 | Smeelen | 315/248 |
| 4,797,595 | 1/1989 | De Jong | 313/493 |
| 4,940,923 | 7/1990 | Kroontje et al. | 315/248 |
| 5,204,584 | 4/1993 | Ikeda et al. | 313/490 |
| 5,274,305 | 12/1993 | Bouchard | 315/117 |
| 5,412,288 | 5/1995 | Borowiec et al. | 315/248 |
| 5,412,289 | 5/1995 | Thomas et al. | 315/248 |
| 5,434,482 | 7/1995 | Borowiec et al. | 315/248 |

*Primary Examiner*—Brian Zimmerman
*Assistant Examiner*—Michael Day

[57] ABSTRACT

This invention relates to electrodeless fluorescent RF lamp which includes a bulbous lamp envelope (10, 20) with a top, a bottom and a fill of rare gas and vaporizable amalgam (14) therein. A reentrant cavity (11, 21) is disposed adjacent the bottom of the envelope (10 *a*, 20*a*) and at least one tubulation (12, 22) extends from the envelope to hold at least a portion of the vaporizable amalgam. An induction coil (2) is disposed on lead wires and coupled with a radio frequency excitation generator for generation of a plasma to produce radiation. At least the major portion of the cold spot where the amalgam resides is maintained at a temperature between about 60° and 140° C. during operation of the lamp, by utilizing a portion of the induction coil to warm up to amalgam.

7 Claims, 3 Drawing Sheets

ELECTRODELESS FLUORESCENT LAMP WITH COLD SPOT CONTROL

BACKGROUND OF THE INVENTION

Electrodeless fluorescent lamps were introduced some years ago with the main objective to extend the life of fluorescent lamps. The basic advantage of fluorescent lamps are their high efficacy. However, even though the life of a fluorescent lamp is substantially longer than that of an incandescent lamp, it is still limited. For example, conventional fluorescent lamps utilizing heated cathodes, T8 and T12, which consume 32–40 watts, last from 12,000 to 24,000 hours. The fundamental limitation of conventional fluorescent lamps is deterioration of the electrodes due to thermal evaporation of a hot cathode and due to the sputtering of cathode material (emissive coating) by plasma ions. Therefore one approach of the prior art has been to eliminate the electrodes and generate plasma which is needed for visual radiation without introduction of the inner electrodes (hot cathodes). This can be achieved by capacitively or inductively coupling electric fields into a rarefied gas mixture thereby inducing an electrical discharge operating at radio frequencies of several MHz, allowed by the FCC, and by microwave plasma operating at the frequency of 916 MHz and higher.

In a typical electrodeless fluorescent lamp utilizing an inductively coupled plasma, an induction coil is inserted inside a reentrant cavity. The induction coil typically has several turns and an inductance of 1–3 $\mu$H. It is energized by a special driver circuit commonly including a matching network (MNW). The RF voltage generated by the driver circuit of fixed frequency (typically 2.65 MHz or 13.56 MHz) is applied across the induction coil. This RF voltage induces a "capacitive" RF electric field in the lamp. When the electric field in the bulb ($E_{cap}$) reaches its "breakdown" value, the capacitive RF discharge ignites the gas mixture in the lamp along the turns of the coil. As the RF voltage applied to the coil ($V_c$) increases, both the RF coil current ($I_c$) and the magnetic field (B) generated by this current increase. However, in capacitively coupled RF discharges operated at RF frequencies of a few MHz, a substantial portion of the RF power is not absorbed by the plasma but is reflected back to the driver circuitry. But even the RF power which is not reflected is not absorbed by the plasma electrons but is mainly spent on the acceleration of ions in the space-charge sheath formed between the plasma and the cavity walls.

The azimuthal RF electric field ($E_{ind}$) induced by the magnetic field flux in the bulb grows with the coil current. When $E_{ind}$ reaches a value which is high enough to maintain the inductively coupled discharge in a lamp, the RF reflected power drops and both coil RF voltage and current decrease while the lamp's visible light output increases dramatically. Further increase of RF power causes an increase of light output, $V_c$ and $I_c$.

One problem encountered with electrodeless lamps having reentrant cavities is thermal management of the coil and cavity wall. Indeed, during the operation at high RF power (P>20W), the coil and cavity wall temperature can reach 300° C. or more if no means of heat removal is provided. The dominant source of the heat is the RF plasma which heats the cavity walls and hence the induction coil also by gas collisions with the cavity walls and infrared radiation. The coil insulating material (typically PFA, i.e., Teflon) starts to deteriorate at 250° C. which makes the coil inoperable. Again, electrical conductivity of soda lime glass increases rapidly as the temperature increases which also aggravates the situation by increasing migration of sodium atoms into the plasma.

The prior art's solution to the problem was to use the heat pipe inside the coil. The heat pipe removes heat from the coil and "dumps" it into the lamp base. However, heat pipes are expensive and hard to construct. Furthermore, heat pipes do not offer a solution to reduced capacitive coupling and improved maintenance and thus did not provide the most economical and practical solution. In a co-pending application of Popov et al., U.S. Serial No. 08/538,239, filed Oct. 3, 1995, now U.S. Pat. No. 5,621,266 and owned by the same assignee as the present application, both electrical and thermal problems are solved by using one structure.

DESCRIPTION OF THE PRIOR ART

As is well known, fluorescent lamps tend to perform poorly at very high ambient temperatures. Traditionally, fluorescent lamps have been used at ambient temperatures of about 25° C. However, as they become more and more compact, the temperature of the coldest spot (cold spot) in the lamp tends to be quite high. Under those circumstances, mercury vapor pressures increase beyond the optimum value and performance of the light source drops considerably. One of the technologies utilized to avoid this effect is the amalgam technology as disclosed by J. Bloem, A. Bouwknegt and G. A. Wasselink, *Journal of IES,* April 1977, p. 141.

Amalgams of mercury have suppressed vapor pressures at elevated temperatures. There are many different kinds of amalgams used for this purpose. In our case we have used Bi-In amalgams which operate well in the 20 °–150° C. temperature regime. Examples of other amalgams could be bismuth-indium (at any weight ratio), bismuth-indium-tin, pure indium, zinc (to form Zn-Hg), zinc-indium-tin, etc. More details about the particular compositions of such amalgams are disclosed in the above mentioned Bloom et al. article. Suppression of the mercury vapor at high temperatures however poses another problem and that at very low ambient temperatures the mercury concentration is insufficient for optimum operation of the lamp. To avoid the lack of sufficient mercury, conventionally an amalgam flag is used. The flag provides an initial puff of mercury vapor to start the lamp and as the lamp warms up the cold spot temperature where the amalgam resides increases to provide the necessary vapor pressure. However, in many cases in order to obtain optimum pressure, light output and efficiency over a wide range of ambient temperatures the cold spot temperature has to be adjusted somewhat further. Borowiec et al. (U.S. Pat. Nos. 5,412,288 and 5,434,482) and Thomas et al. (U.S. Pat. No. 5,412,289) discuss some of the approaches taken by prior art in locating an amalgam at the desired location. Obtaining the optimum temperature for the amalgam is often a problem because it is not desirable to employ heaters or various pieces of equipment to adjust the amalgam vapor pressure.

SUMMARY OF THE INVENTION

We have found that if the amalgam composition and the location of the amalgam is fixed so as to obtain an optimum performance at ambient temperatures between −20° C. and 60° C. in base up (BU) operation, then the amalgam temperature would be lower than optimum with base down (BD) operation, leading to poor performance. A variety of insulation techniques currently in use to raise the temperature of the amalgam have not been found to be satisfactory.

Therefore, an object of the present invention is to provide a solution for the low temperature performance of the amalgam and raise the temperature so high performance temperature is not effected and additional thermal or electrical complications to the matching network or any other part of the lamp are not introduced.

Another object of the present invention is the design of an electrodeless lamp having a light output that does not deviate more than 20% from the optimum value at ambient temperatures of −20° C. to +60° C.

Yet another object of the present invention is to provide necessary heating for the amalgam spot without additional heaters or tapes or thermoelectric cooler/heater devices.

A further object of the present invention is to provide an economical solution to raising the temperature of the cold spot in the electrodeless lamp.

Another object of the present invention is to locate the amalgam so its results are reproducible and optimum, while being compatible with manufacturing techniques.

A further object of the present invention is to elevate the temperature of the cold spot at an ambient temperature of −20° C. to about 60° C. and when the ambient temperature is at 60° C. to elevate it to no more than about 140° C.

It is also the objective of the present invention to utilize heat available within the cavity of the lamp and re-channel some of this heat to the point where the amalgam is located in the most convenient and practical manner.

BRIEF DESCRIPTION OF THE DRAWING

FIG. 2A shows a so-called "C"-type (C for central tubulation) and FIG. 2B shows a so-called "S"-type (S for side tubulation).

DESCRIPTION OF THE PREFERRED EMBODIMENT

Figure 1:
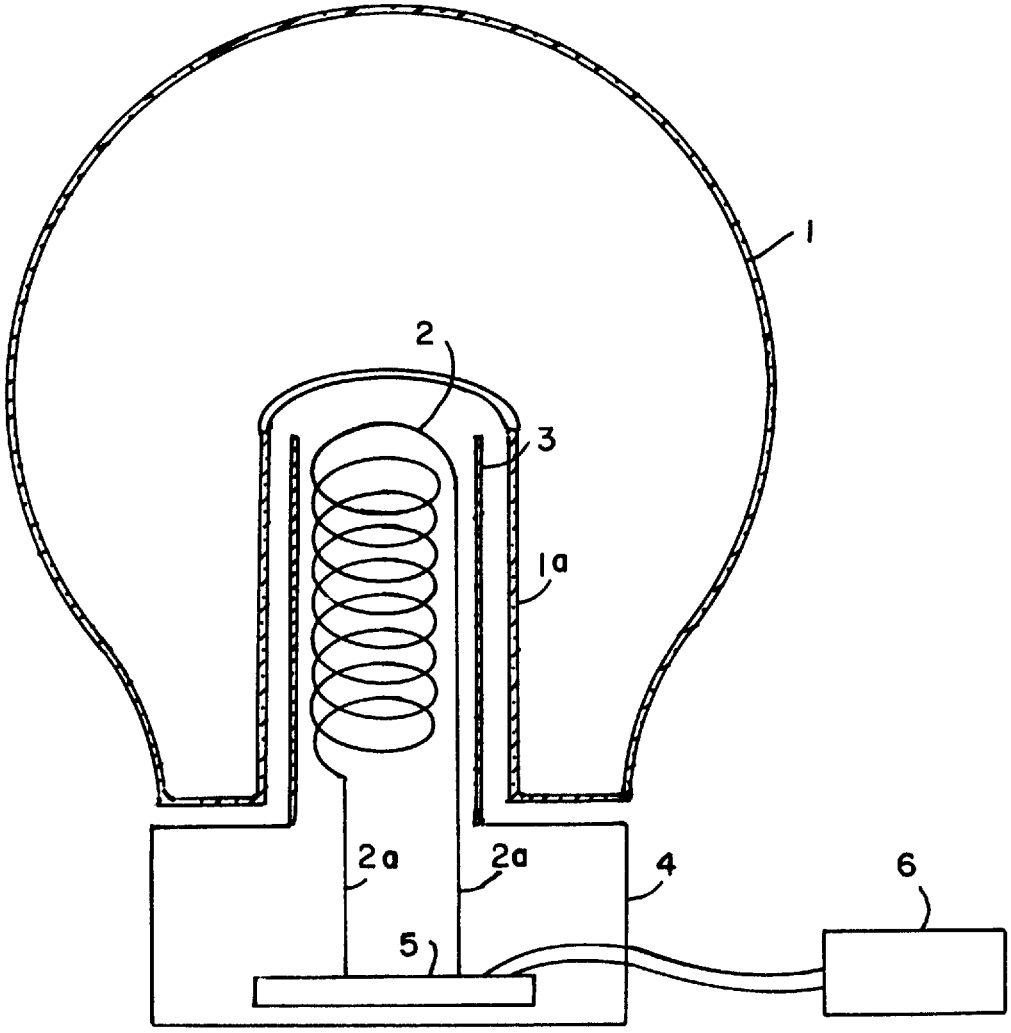
FIG. 1 is a cross-sectional, elevational view of a generic electrodeless lamp with heat removal and electromagnetic interference (EMI) reduction structure as well as an excitation coil inside the cavity.

FIG. 1 illustrates a conventional electrodeless fluorescent discharge lamp having an envelope 1 containing an ionizable gaseous fill. The construction is similar to the device described in the above-mentioned Popov et al. application. A suitable fill, for example, comprises a mixture of rare gasses, mercury vapor and/or some other metal vapor. An excitation coil 2 with lead wires 2*a* is situated within a reentrant cavity la and is removable from the reentrant cavity 1*a* within the envelope 1. A heat removal structure 3 made of slotted aluminum is disposed between the coil 2 and the cavity 1*a* to remove heat from the coil 2, reduce electromagnetic interference and heat transfer to the matching network device 5 as described in the above-mentioned co-pending application. The lamp is connected to a conventional driver circuit 6. The structure 3 is thermally connected to a fixture 4 of the lamp. The heat removal structure 3 and the fixture 4 provides a base for the lamp and channels heat from the coil 2 through the base 4 as a heat sink and also provides electromagnetic interference reduction (EMI reduction) by way of containing some of the EMI radiation.

As described above, fluorescent lamps and in particular electrodeless fluorescent lamps are very sensitive to the pressure of mercury and the pressure of mercury is primarily determined by where the coldest spot of the lamp happens to be. This is typically called the cold spot temperature ($T_{CS}$). Such sensitivity is because mercury tends to migrate to the coldest spot and deposits there. Eventually the cold spot temperature determines the vapor pressure above the mercury droplets disposed therein. The quantity of mercury also eventually determines the light output and the efficiency of the lamp. Therefore, it is important that the light source has the most advantageous quantity of mercury or the right vapor pressure which in turn is controlled by the cold spot. We have found the cold spot of an electrodeless lamp with a base operated at ambient temperatures up to about 60° C. can produce temperatures upwards of 120°–150° C. At those temperatures the mercury vapor pressure is well beyond optimum and the light output is low. To ameliorate this situation, an amalgam including bismuth and indium is typically used. With such an amalgam, the pressure of mercury is suppressed to a level so the light output is considerably improved. For example, at 140° C. with a bead of bismuth and indium of 70/30 weight ratio and about 3 to 4% mercury by weight composition, a mercury vapor pressure at 140° C. is attained which is about the same as the mercury pressure of pure mercury if the cold spot were at about 40° C.

Figure 2A:
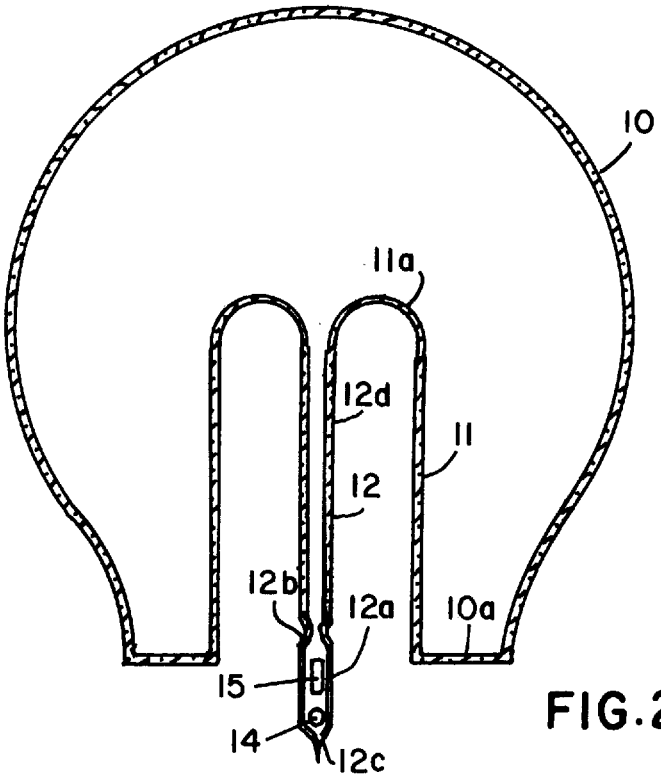
FIGS. 2A and 2B are schematic, elevational views showing two different embodiments of the envelope of the lamp in cross-section.

Referring to FIG. 2A, experiments were run with a "C"-type configuration in the base. A "C"-type lamp includes a bulbous envelope 10 having a reentrant cavity 11. A bottom 10*a* is disposed at the lower end of the envelope 10 and the reentrant cavity 11 is disposed within it. The proximal end 12*d* of an exhaust tubulation 12 extends from the top 11*a* of the cavity 11. It is centrally disposed within the cavity 11 and extends generally along the axis of the envelope 10 to end in a tip-off 12*c*. The interior of the tubulation 12 is open to the interior of the envelope 10. A quantity of amalgam 14 is disposed within a enclosure 12*a* of the tubulation 12. A small piece of glass tubing 15 is disposed within the tubulation 12 to prevent the amalgam 14 from falling into the envelope 10 and scratching the phosphor coating (not shown). A crimp 12*b* separates the enclosure 12*a* from tubulation 12 and holds the tubing in place.

Figure 2B:
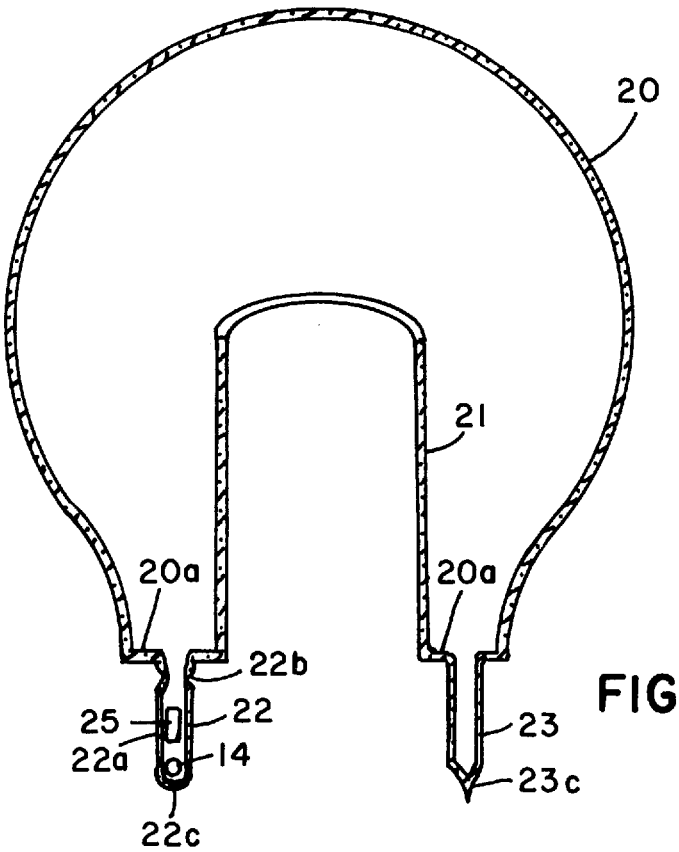

Referring to FIG. 2B an "S"-type lamp is shown. It includes a bulbous envelope 20, similar to the envelope disclosed in FIG. 2A. The envelope 20 has a centrally disposed reentrant cavity 21. A bottom 20*a* is disposed at the lower end of the envelope 20 and the reentrant cavity 21 extends from it. A pair of exhaust tubulations 22 and 23 extend from the bottom 20*a* and end in conventional tip-off 22*c* and 23*c*, respectively. The interior of the tubulations 22 and 23 are open to the interior of the envelope 20. A quantity of amalgam 14 is disposed within a enclosure 22*a* of the tubulation 22. A small piece of glass tubing 25 is disposed within the tubulation 22 to prevent the amalgam 14 from falling into the envelope 20 and scratching the phosphor coating (not shown). A crimp 22*b* separates the enclosure 22*a* from tubulation 22. The other tubulation 23 can be identical to tubulation 22, but without the amalgam or crimping. The second tubulation 23 is helpful in lamp making because it allows exhausting the envelope 20 without interference from the amalgam or other fittings.

We found that at −20° C., even though we were able to reduce the temperature of the matching network considerably which is one of the additional constraints that we had, the cold spot temperature of the amalgam was below optimum in such a manner that we were obtaining about 75–80% of the optimum light output. Thus, it was determined the temperature of the cold spot could be increased without affecting the temperature of the coil or the temperature of the matching network. It was determined the distance between the matching network and the cold spot, the distance between the coil and cold spot, and materials used between the matching network and the coil and the lamp, were all critical parameters and of great importance in determining the optimum operational temperature of the cold spot and to maintain it at an ambient temperature range of −20° C. to +60° C. It was recognized that the hottest temperature in the whole envelope and base is in the coil. It was found it is possible to channel some of the coil's heat from the coil to the cold spot. Such channeling could be conveniently done either by bringing the cold spot somewhat closer to the coil which would mean tipping-off the tubulation somewhat closer to the coil or transferring heat from the coil onto the cold spot by heating the tubulation to obtain the optimum ambient temperature range. These were tried with bulbs made at 105 mm diameter and powered with 58 watts in both base up and base down configurations. The bulb has an aluminum heat removal structure (as disclosed in the co-pending application mentioned above) and a coil of 2.3 $\mu$H for the excitation. The bulb was filled with low pressure argon gas and mercury and it was coated with the usual triphosphors that are used in compact fluorescent lamps. Such embodiments are shown in FIGS. 3A and 3B.

Figure 3A:
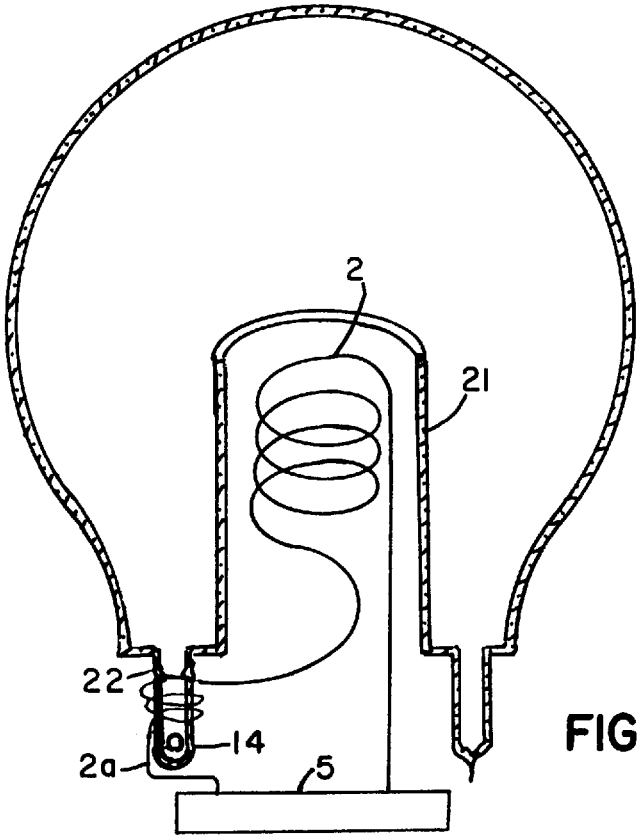
FIGS. 3A and 3B are schematic, elevational views taken in cross-section illustrating two embodiments for controlling the temperature of the amalgam at cold spots in the envelopes.
Figure 3B:
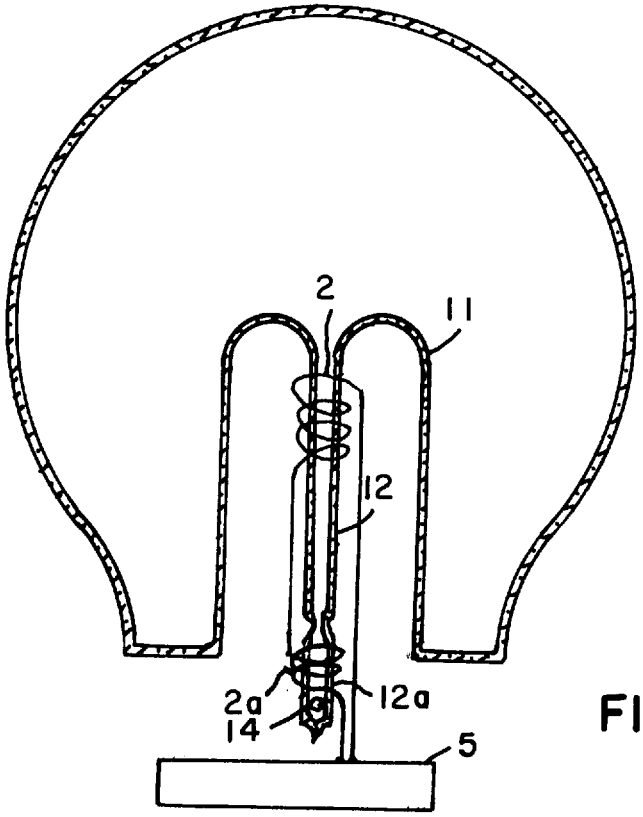

Referring to FIGS. 3A and 3B, a two configurations of coil arrangements are shown. The lamp of FIG. 3B has a "C"-type configuration and the lamp of FIG. 3A has an "S"-type configuration. A coil 2 is disposed on the tubulation 12 of the "C"-type with several turns 2*a* around the enclosure 12*a* and the increase in heat was measured while the temperatures of the matching network 5 and coil 2 were monitored. We found that the matching network 5 was not adversely affected by having a few additional small turns 2*a* around the enclosure 12*a* that contains the amalgam 14 therefore not necessitating any change in the lamp's components. In addition, we found that the temperature was increased by as much as 20° C. as a result of adding 4½ turns of coil around the amalgam 14. We also tried one turn, three turns, and four turns of the coil, and we found as the number of turns decreased the amount of heating supplied to the amalgam 14 was somewhat reduced.

Such modifications as described above with reference to the "C"-type envelope were also tried with the "S"-type lamp shown in FIG. 3A and described above. As with the FIG. 3A embodiment, a few turns 2*a* of coil 2 are wrapped around the tubulation 22. Both embodiments provided between 7° and 25° temperature rise for the cold spot temperature, bringing the temperature within the optimum range. Through wrapping portions of the coil 2 around the tubulation it was possible to obtain optimum performance within the preferred ambient temperature range of −20° C. to +60° C. By adjusting the turns, both in number and in relation to location of the amalgam the temperature could be adjusted also.

It was found the closer the amalgam is to the center of the coil, less heating is required because as one approaches the coil center the temperature increases to reach a point where there would not be any need for additional heating. A coil is wrapped around the tubulation 12 as shown in FIG. 3A. We found if the distance between the tip-off 12*c* and the crimp 12*b* is short, then the base up and base down operations are not significantly different in terms of thermal characterization and the cold spot may not need much heating to reach the optimum range. Diversion of heat from the excitation coil to the amalgam can take on many different forms. This can be by way of the excitation coil being looped around the tip where the amalgam is. In another embodiment, the amalgam can be sandwiched between two sets of barriers to precisely maintain its location constant relative to the excitation coil in a base up or base down operation thereby maintaining an optimum vapor pressure of Hg over a wide ambient temperature range. Alternatively, a heat shield could be utilized where the heat of the coil is reflected onto the tip where the amalgam is disposed.

While it is apparent that changes and modifications can be made within the spirit and scope of the present invention, it is our intention, however, only to be limited by the appended claims.

As our invention we claim:

1. An electrodeless fluorescent RF lamp comprising:

a bulbous lamp envelope having a top and a bottom and a fill of rare gas and vaporizable amalgam in said envelope;

a reentrant cavity disposed adjacent the bottom of said envelope and entering into said envelope;

a tubulation extending from said envelope, the interior of said tubulation being in communication with the interior of said envelope, at least the major portion of said vaporizable amalgam being disposed within said tubulation;

an induction coil for the generation of a plasma to produce radiation, said coil being situated outside said envelope and fitted within said cavity;

a heating coil electrically connected to the induction coil, said heating coil being thermally connected to said tubulation adjacent to said amalgam whereby to maintain said amalgam at a temperature between about 60° and 140° C. during operation of said lamp.

2. The lamp according to claim 1 wherein said re-entrant cavity is axially disposed within said envelope, said tubulation extending from said cavity and beneath the bottom of said envelope whereby to hold said amalgam.

3. The lamp according to claim 1 further including an enclosure in said tubulation, said enclosure being adapted to retain solid materials therein whereby to help maintain said amalgam at said temperature.

4. The lamp according to claim 1 wherein a means thermally connecting said coil is at least one turn of a lead wire wrapped around said tubulation.

5. The lamp according to claim 1 wherein said re-entrant cavity is axially disposed within said envelope, and wherein said tubulation extends from said bottom of said envelope whereby to hold said amalgam.

6. The lamp according to claim 5 wherein there are two tubulations extending from said bottom, one of said tubulations having an enclosure disposed therein whereby to hold said amalgam.

7. The lamp according to claim 1 further including an enclosure in said tubulation, said enclosure being adapted to retain solid materials therein.

* * * * *